US009380808B2

(12) United States Patent
Bao

(10) Patent No.: US 9,380,808 B2
(45) Date of Patent: Jul. 5, 2016

(54) CIGARETTE TOBACCO FILLER DEVICE

(76) Inventor: Fan Bao, City of Industry, CA (US)

( * ) Notice: Subject to any disclaimer, the term of this patent is extended or adjusted under 35 U.S.C. 154(b) by 1184 days.

(21) Appl. No.: 13/374,219

(22) Filed: Dec. 15, 2011

(65) Prior Publication Data

US 2013/0152952 A1 Jun. 20, 2013

(51) Int. Cl.
*A24C 5/42* (2006.01)

(52) U.S. Cl.
CPC ..... *A24C 5/42* (2013.01)

(58) Field of Classification Search
CPC ..... A24C 5/42; A24C 5/06; A24C 5/02; A24C 5/40
USPC ..... 131/70–75
See application file for complete search history.

(56) References Cited

U.S. PATENT DOCUMENTS 5,088,506 A * 2/1992 Kastner ..... 131/70

* cited by examiner

*Primary Examiner* — Michael H Wilson
*Assistant Examiner* — Dionne Walls Mayes
(74) *Attorney, Agent, or Firm* — One LLP

(57) ABSTRACT

A cigarette tobacco filler device includes a casing having an outlet for holding a cigarette tube in position, a plunger movably supported in said casing for delivering tobacco into the cigarette tube, and a plunger actuation unit which includes a power shaft rotatably supported in the casing to couple with the plunger and an operation handle which is pivotally extended above the top side of the casing and is arranged in such a manner that when the operation handle is pivotally moved down to the top side of the casing, the power shaft is driven to rotate so as to actuate the plunger for inserting the tobacco to the cigarette tube at the outlet.

26 Claims, 11 Drawing Sheets

CIGARETTE TOBACCO FILLER DEVICE

BACKGROUND OF THE PRESENT INVENTION

1. Field of Invention

The present invention relates to a cigarette making machine, and more particular to a cigarette tobacco filler device, which is easy to operate by pivotally moving down an operation handle to actuate the plunger for filling the tobacco into the cigarette tube.

2. Description of Related Arts

A conventional cigarette machine generally comprises an injection device received in a casing and a manually actuation device for actuating the injection device. The injection device comprises a plunger being actuated by the actuation device for filling a predetermined amount of tobacco into an empty cigarette tube.

The injection device comprises a tobacco receiving chamber provided on a top side of the casing 10A for receiving an sufficient amount of tobacco, wherein when the plunger 11A is actuated, the tobacco in the tobacco receiving chamber is pushed by the plunger 11A and is filled into the cigarette tube. In particular, a window 18A is provided at the top side of the casing 10A and is actuated by the actuation device to enclose the tobacco receiving chamber. The window 18A has a sharp cutting edge arranged in such a manner that when the window 18A is moved to enclose the tobacco receiving chamber, the cutting edge of the window 18A is moved to cut the excessive amount of tobacco out of the tobacco receiving chamber so as to retain the sufficient tobacco therein for one single cigarette tube.

Furthermore, the actuation device comprises a rotatable handle 12A rotatably coupled on a top side of the casing 10A and an actuation link connected between the rotatable handle and the plunger 11A, as shown in FIG. 2A. The rotatable handle 12A is rotated on the top side of the casing 10A at the same planer direction to provide dual action operation, as shown in FIG. 1. In other words, the rotatable handle 12A is rotated to actuate the window 18A for closing the tobacco receiving chamber first and then to actuate the plunger 11A for pushing the tobacco into the cigarette tube. The actuation device comprises a cam 13A driven by the rotatable handle 12A, a window link connected between the cam and the window 18A, and a plunger link connected between the cam 13A and the plunger 11A. The window link comprises a transverse link 14A and a plurality of longitudinal links 15A. The plunger link comprises a plunger actuation arm 16A connected to the plunger 11A.

The rotatable handle 12A is rotated resulting in a corresponding rotary movement in axle and integrally attached cam, wherein the rotary movement of cam 13A urges the transverse link 14A to move. The longitudinal links 15A are rotatably pivoted at one end to the transverse link 14A to actuate the window 18A for closing the tobacco receiving chamber, as shown in FIG. 2B.

Once the window 18A is actuated to close the tobacco receiving chamber, the rotatable handle 12A is kept rotating to actuate the plunger actuation arm 16A. The rotatable movement of the plunger actuation arm 16A is transmitted to move the plunger 11A in a linear movement. A compression spring 17A is connected to the plunger actuation arm 16A to pull the plunger actuation arm 16A back to its original position so as to move the plunger 11A back in a linear movement.

The cam 13A has an arc-shaped guiding channel 131A, wherein the driving end of the transverse link 14A is guided to slide along the guiding channel 131A. In particular, when the cam 13A is rotated, the driving end of the transverse link 14A is slid from the closed end of the guiding channel 131A to the opened end thereof. Therefore, the transverse link 14A is guided to move linearly so as to move the window 18A in a longitudinally linear movement through the longitudinal links 15A. Once the driving end of the transverse link 14A is slid out of the guiding channel 131A, the plunger actuation arm 16A is started to be driven by the rotary movement of the cam 13A. In other words, the cam 13A with the guiding channel 131A provides the dual action operation for the window 18A and the plunger 11A. However, the conventional cigarette machine has several drawbacks.

The casing 10A cannot be stably placed on a surface, such as a table surface, when the rotatable handle 12A is actuated. Since the rotatable handle 12A is driven to rotate above the top side of the casing 10A, the rotatable force at the rotatable handle 12A will be transmitted not only to the cam 13A but also the casing 10A. In particular, the rotation of the rotatable handle 12A by the user's hand is not ergonomic actuation to optimize the force applied by the user. Therefore, the casing 10A will be unstably moved on the surface. In addition, the rotatable handle 12A is rotated to drive two different mechanisms, i.e. the window link and the plunger link, to operate two different rotatable forces at one single continuous motion. Even though a frictional support is provided at the bottom side of the casing 10A to support on the surface, the two different rotatable forces will create different torques to the casing 10A to move the casing 10A on the surface. Therefore, the casing 10A will be moved no matter how the user hold the casing 10A tightly.

Furthermore, the rotatable movement of the cam 13A via the rotatable handle 12A will be transmitted to two different linear movements at different directions. The first linear movement is the longitudinal movement of the window 18A and the second linear movement is the transverse movement of the plunger 11A. Accordingly, the rotatable force at the cam 13A must be large enough to transmit to both the longitudinal force and the transverse force to actuate the window 18A and the plunger 11A respectively. Once one of the window link and the plunger link is broken, the entire machine will not be operated at all. Especially the pivot connection between the transverse link 14A and the longitudinal link 15A of the window link is the weakest connection among the mechanisms, the excessive rotatable force will break the pivot connection easily. Since the cam 13A is located away from the window 18A, the rotatable force from the cam 13A must be transmitted to the longitudinal force through the transverse link 14A and the longitudinal link 15A. However, the longitudinal force may not be able to evenly apply to the window 18A. Therefore, the closing action at the window 18A will not be smooth due to the uneven pivotal movements of the longitudinal links 15A.

The window 18A is remained at opened position when the machine is not in use. Accordingly, dust or other particles will be accumulated in the tobacco receiving chamber and will mix with the tobacco. In addition, the sharp cutting edge of the window 18A will be exposed resulting in any accidentally injury. In other words, there is no locking mechanism to lock up the window 18A at the closed position when the machine is not in use.

Since the compression spring 17A is kept loading to pull the plunger 11A back to its original position, the fatigue life of the compression spring 17A will be substantially shortened. Accordingly, the transverse force at the plunger 11A must overcome the spring force in order to push the plunger 11A forward. Then, the plunger 11A is pulled back by the spring force. In particular, the compression spring 17A is mounted to the plunger actuation arm 16A. When the plunger actuation arm 16A is pivotally moved to transmit the rotatable force to the transverse force at the plunger 11A, the compression spring 17A will be stretched unevenly. In other words, the compression spring 17A is stretched by the pivotal movement of the plunger actuation resulting in shortening the service life span of the compression spring 17A.

SUMMARY OF THE PRESENT INVENTION

The invention is advantageous in that it provides a cigarette tobacco filler device, which is easy to operate by pivotally moving down an operation handle in an ergonomically actuating manner to actuate the plunger for filling the tobacco into the cigarette tube.

Another advantage of the invention is to provide a cigarette tobacco filler device, wherein the pivotally downward movement of the operation handle will ensure the casing being stably stayed on a surface to prevent any unwanted movement of the casing during operation.

Another advantage of the invention is to provide a cigarette tobacco filler device, wherein the pivotally downward movement of the operation handle will transmit to a rotatable force to drive a power shaft to rotate in order to effectively actuate the enclosing window and the plunger. In other words, the enclosing window and the plunger are actuated by the power shaft to effectively transmit the rotatable force to the enclosing window and the plunger.

Another advantage of the invention is to provide a cigarette tobacco filler device, wherein the operation handle provides triple-action actuation of the enclosing window, the plunger, and release of cigarette tube in one single downward movement.

Another advantage of the invention is to provide a cigarette tobacco filler device, wherein the power shaft is made of rigid material and is strong enough to transmit the rotatable force to actuate the enclosing window and the plunger.

Another advantage of the invention is to provide a cigarette tobacco filler device, wherein the operation handle can be unlocked to freely rotate with respect to the power shaft such that the plunger and the enclosing window will not be actuated by the operation handle when the device is not intentionally be used.

Another advantage of the invention is to provide a cigarette tobacco filler device, wherein the tobacco receiving cavity can be closed by the enclosing window when the device is not in use so as to prevent dust or other particles being accumulated in the tobacco receiving cavity.

Another advantage of the invention is to provide a cigarette tobacco filler device, wherein the enclosing window is stably moved between an opened position and a closed position by an even transverse force which is transmitted from the rotatable force of the power shaft.

Another advantage of the invention is to provide a cigarette tobacco filler device, which does not involve complicated mechanical structures or expensive components so as to minimize the manufacturing cost of the present invention.

Another advantage of the invention is to provide a cigarette tobacco filler device, wherein no expensive or complicated structure is required to employ in the present invention in order to achieve the above mentioned objects. Therefore, the present invention successfully provides an economic and efficient solution for providing a stable configuration and easy operation of cigarette tobacco filler device.

Additional advantages and features of the invention will become apparent from the description which follows, and may be realized by means of the instrumentalities and combinations particular point out in the appended claims.

According to the present invention, the foregoing and other objects and advantages are attained by a cigarette tobacco filler device for filling a predetermined amount of tobacco into an empty cigarette tube, comprising:

a casing having a tobacco receiving cavity provided at a top side of the casing for receiving the tobacco, and an outlet which is communicated with the tobacco receiving cavity and is adapted for holding the cigarette tube in position;

an injection unit which comprises a plunger movably supported in the casing at a position that a front pushing end of the plunger is moved from the tobacco receiving cavity to the outlet for delivering the tobacco into the cigarette tube; and an actuation unit which comprises a power shaft rotatably supported in the casing to couple with the plunger and an operation handle which is pivotally extended above the top side of the casing and is arranged in such a manner that when the operation handle is pivotally moved down to the top side of the casing, the power shaft is driven to rotate so as to actuate the plunger for inserting the tobacco in the tobacco receiving cavity to the cigarette tube at the outlet.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
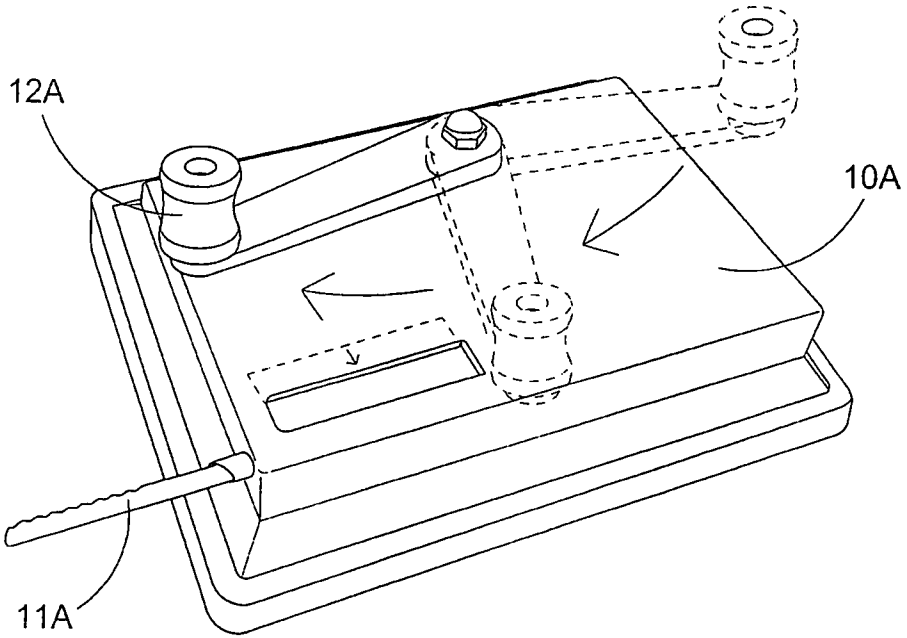
FIG. 1 PRIOR ART
FIG. 1 is a perspective view of a conventional cigarette making machine, illustrating the rotatable handle being rotated above the top side of the casing.
Figure 2A:
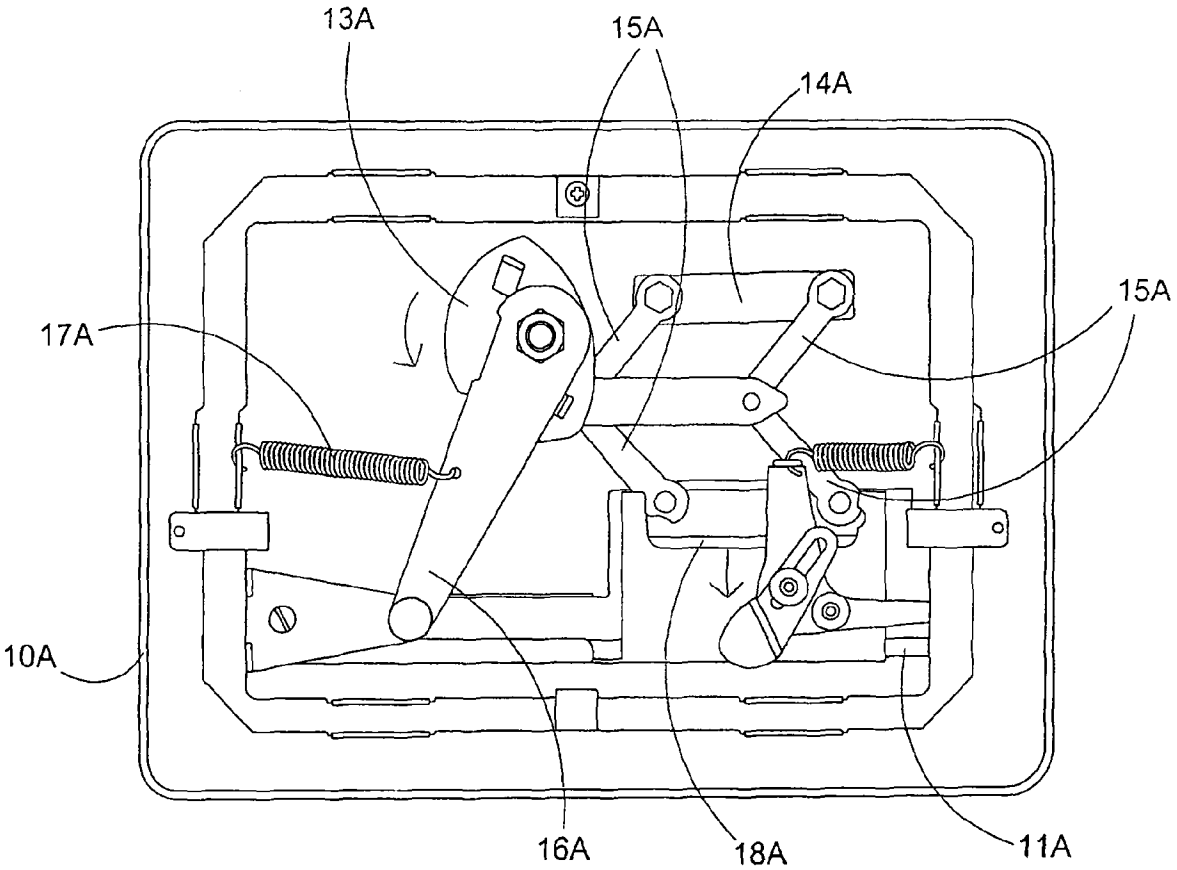
FIG.2A PRIOR ART
FIGS. 2A to 2C illustrate the operation of the conventional cigarette making machine.
Figure 2B:
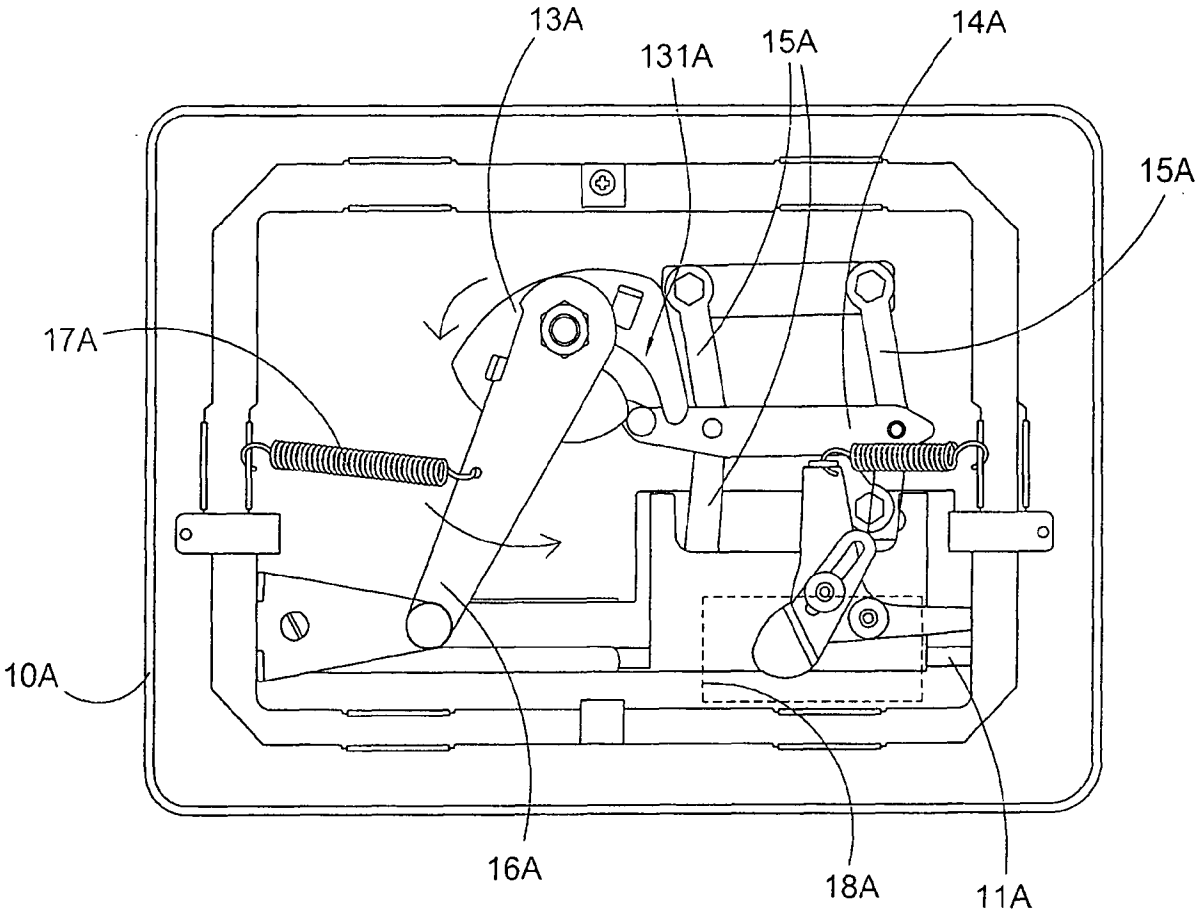
FIG.2B PRIOR ART
Figure 2C:
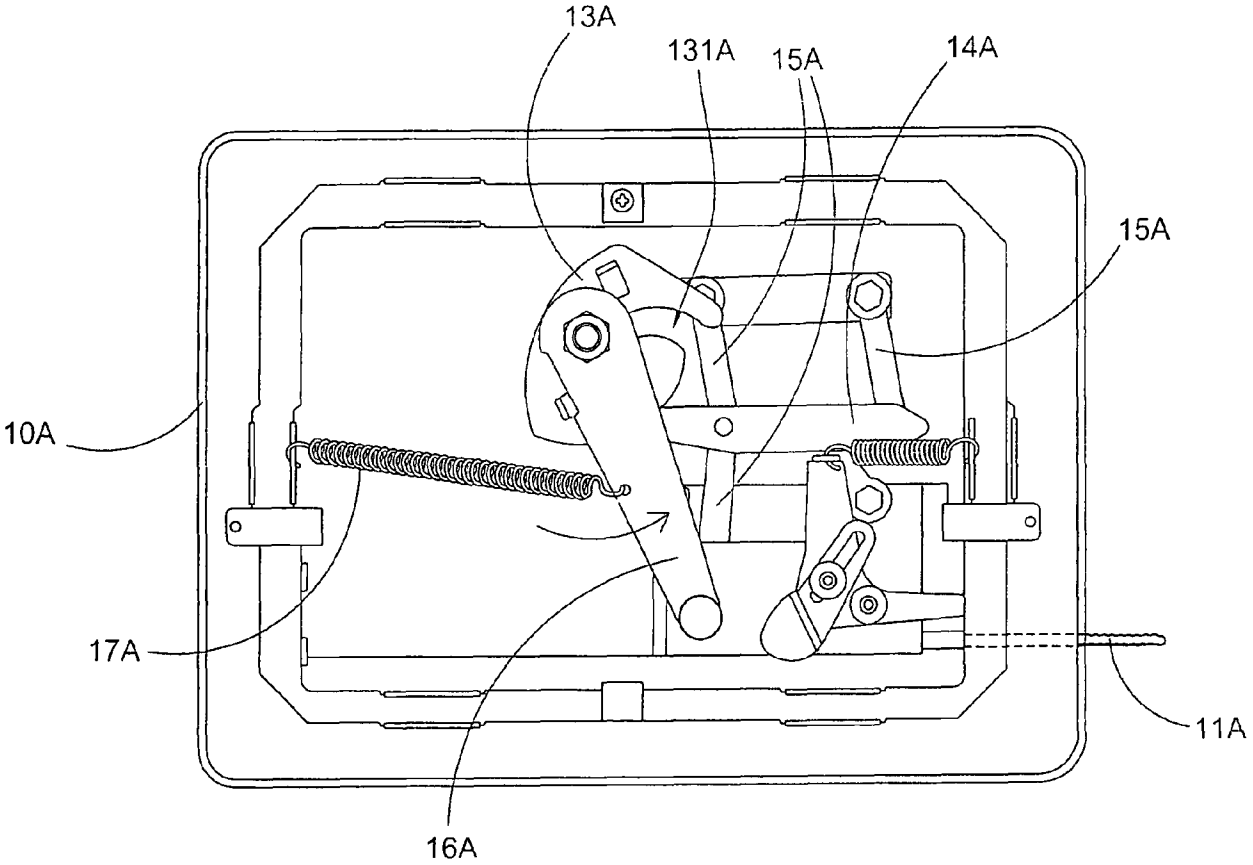
FIG.2C PRIOR ART

Referring to FIGS. 3A to 3C and 4 to 7, a cigarette tobacco filler device according to a preferred embodiment of the present invention is illustrated, wherein the cigarette tobacco filler device, which is arranged for filling a predetermined amount of tobacco into an empty cigarette tube, comprises a casing 10, and an injection unit 20, and a plunger actuation unit 30.

The casing 10 has a tobacco receiving cavity 11 provided at a top side of the casing 10 for receiving the tobacco, and an outlet 12 provided at a front side of the casing 10 for holding the cigarette tube in position, wherein the outlet 12 is communicated with the tobacco receiving cavity 11. The outlet 12 has tubular structure having a circumferential size slightly smaller than the circumferential size such that the outlet 12 is adapted for inserting into the opening end of the cigarette tube to hold the cigarette tube in position. The casing 10 further has a sloping platform 13 provided at the top side of the casing 10 to align with the top opening of the tobacco receiving cavity 11, wherein the sloping platform 13 is downwardly extended to the tobacco receiving cavity 11 such that the user is able to brush the tobacco at the sloping platform 13 into the tobacco receiving cavity 11. The casing 10 further comprises a handle bar 14 spacedly extended above the top side of the casing 10 and extended between the front and rear sides of the casing 10 for carrying purpose.

The casing 10 further has an interior cavity for receiving the injection unit 20, and the plunger actuation unit 30, wherein a bottom panel 15 is coupled at the bottom side of the casing 10 to enclose the interior cavity.

The injection unit 20 comprises a plunger 21 movably supported in the casing 10 at a position that a front pushing end 211 of the plunger 21 is moved forward from the tobacco receiving cavity 11 to the outlet 12 for delivering the tobacco into the cigarette tube. Accordingly, the plunger 21 has an elongated structure and is moved in the casing 10 at a longitudinal direction of the casing 10. In particular, the plunger 21 is coaxially align with the outlet 12, such that when the plunger 21 is moved forward in a linear manner, the front pushing end 211 of the plunger 21 will push the tobacco in the tobacco receiving cavity 11 into the cigarette tube through the outlet 12.

The injection unit 20 further has a linear guiding channel 22 longitudinally formed within the casing 10 to guide the longitudinal movement of the plunger 21. Accordingly, the injection unit 20 comprises two elongated plunger guiding arms 23 defining the guiding channel 22 therebetween, wherein the plunger 21 is slidably coupled between the plunger guiding arms 23 along the guiding channel 22 to ensure the plunger 21 being move longitudinally.

The plunger actuation unit 30 comprises a power shaft 31 rotatably supported in the casing to couple with the plunger 21 and an operation handle 32 pivotally extended above the top side of the casing 10, wherein when the operation handle 32 is pivotally moved down to the top side of the casing 10, the power shaft 31 is driven to rotate. Accordingly, the power shaft 31 will provide a rotatable power to actuate the plunger 21 for inserting the tobacco in the tobacco receiving cavity 11 to the cigarette tube at the outlet 12. When the operation handle 32 is pivotally moved up from the top side of the casing 10, the power shaft 31 is driven to rotate at an opposite direction, wherein the plunger 21 will move backward in a linear manner so as to move back to its original position.

The power shaft 31 is a main power transmitting element for transmitting the rotatable power from the operation handle 32. One end of the power shaft 31 is coupled with the bottom end of the operation handle 32 such that when the upper end of the operation handle 32 is pivotally moved down toward the top side of the casing 10, the power shaft 31 is driven to rotate for generating the rotatable power. Accordingly, the plunger 21 and the power shaft 31 are spacedly supported within the casing 10 and are extended parallelly to each other.

It is appreciated that the user is able to apply a downward force at the operation handle 32 to drive the operation handle 32 pivotally moving down toward the top side of the casing 10. The pivotally downward movement of the operation handle 32 allows the user to easily operate the operation handle 32 in an ergonomically actuating manner for completing the filling of the tobacco into the cigarette tube. In other words, the pivotally downward movement of the operation handle 32 is designed to optimize how the force applied by the user and to enhance the overall device performance.

By applying the downward force, the casing 10 will be stably rested on a surface, such as a table surface, so as to prevent any unwanted movement of the casing during the operation of the cigarette tobacco filler device. Preferably, the operation handle 32 is coupled at a rear side of the casing 10 to maximize the distance between the operation handle 32 and the outlet 12 for easy operation.

According to the preferred embodiment, the plunger actuation unit 30 further comprises a gear unit 33 driven by the power shaft 31 and an actuation arm 34 for actuating the plunger 21. The actuation arm 34 has a pivot end operatively coupled with the gear unit 33 and a driving end operatively coupled with the plunger 21 in such a manner that when the power shaft 31 is driven to rotate, the actuation arm 34 is pivotally moved to longitudinally move the plunger 21 forward for pushing the tobacco to the outlet 12.

As shown in FIGS. 4 to 7, the actuation arm 34 comprises a first arm member 341 pivotally coupled with the gear unit 33 and a second arm member 342 pivotally coupled at the rear end of the plunger 21, wherein the first and second arm members 341, 342 are pivotally coupled with each other in an end-to-end manner. Accordingly, the pivot end of the actuation arm 34 is defined at the first arm member 341 to pivotally couple with the gear unit 33 while the driving end of the actuation arm 34 is defined at the second arm member 342 to couple at the rear end of the plunger 21.

Therefore, when the first arm member 341 is pivotally moved to the front side of the casing 10, the second arm member 342 is driven to longitudinally move the plunger 21 forward. When the first arm member 341 is pivotally moved back to the rear side of the casing 10, the second arm member 342 is driven to longitudinally move the plunger 21 backward.

The gear unit 33 is arranged to transmit the rotatable power from the power shaft 31 to a pivotal movement of the actuation arm 34. In particular, the gear unit 33 comprises a first gear 331 coaxially coupled at the power shaft 31 and a second gear 332 which is coupled at the pivot end of the actuation arm 34 and is operatively engaged with the first gear 331. In particular, the second gear 332 will also transmit the direction of the rotatable power from the first gear 331 to the actuation arm 34.

The first gear 331 has a teething edge portion and a non-teething edge portion provided at the circumferential edge of the first gear 331. The second gear 332 has a teeth edge portion to selectively engage with the teething edge portion and the non-teething edge portion of the first gear 331 when the first gear 331 is rotated.

Accordingly, when the first gear 331 is rotated at a position that the non-teething edge portion of the first gear 331 is engaged with the second gear 332, the second gear 332 is idle such that the actuation arm 34 is remained at a motionless manner. When the first gear 331 is rotated at a position that the teething edge portion of the first gear 331 is engaged with the second gear 332, the second gear 332 is driven to rotate to pivotally move the actuation arm 34 so as to longitudinally move the plunger 21 forward.

It is worth mentioning that the non-teething edge portion of the first gear 331 is initially engaged with the second gear 332. When the operation handle 32 is pivotally moved downward, the teething edge portion of the first gear 331 will then be engaged with the second gear 332. Therefore, the second gear 332 will be in an idle position at the first pivotal moving path of the operation handle 32. In addition, the curvature length of the teething edge portion of the first gear 331 is long enough to driven the plunger 21 to longitudinally move by the actuation arm 34 for inserting the tobacco into the cigarette tube.

As shown in FIGS. 3 to 7, the plunger actuation unit 30 further comprises a resilient element 35 coupled at the actuation arm 34 for applying an urging force thereagainst so as to longitudinally move the plunger 21 backward. Accordingly, the resilient element 35 comprises a coil spring for urging the actuation arm 34. In particular, the coil spring of the resilient element 35 has a coil portion coaxially coupled at the pivot end of the actuation arm 34 and two spring arms spacedly extended from the coil portion to bias against an inner wall of the casing 10 and the actuation arm 34 respectively. Accordingly, the respective spring arm of the resilient element 35 is coupled at the actuation arm 34 between the pivot end and the driving end. In particular, the respective spring arm of the resilient element 35 is coupled at the first arm member 341. It is worth mentioning that the coil spring has a spring property to move the actuation arm 34 is a pivotally movable manner. Therefore, the fatigue life of the coil spring incorporating with the actuation arm will be substantially prolonged to extend the service life span of the resilient element 35.

Figure 5:
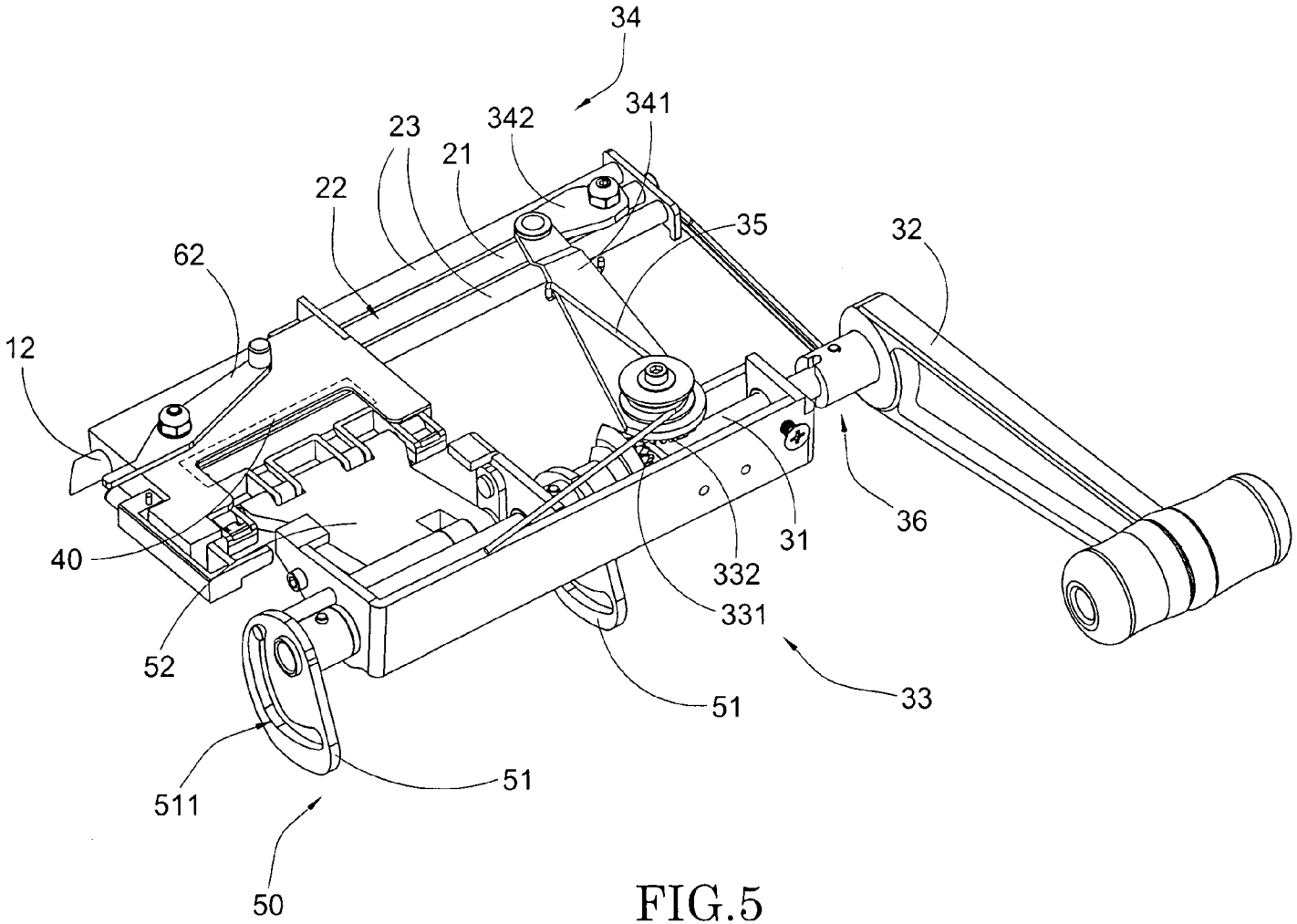
FIG. 5 is a perspective view of the cigarette tobacco filler device according to the above preferred embodiment of the present invention, illustrating the normal first position of the device.

According to the preferred embodiment, the cigarette tobacco filler device further comprises an enclosing window 40 movably coupled at the casing 10 to enclose the tobacco receiving cavity 11 thereof. Accordingly, the enclosing window 40 has a planar structure and is transversely moved to close the tobacco receiving cavity 11. In particular, the enclosing window 40 is movably coupled at the interior of the top side of the casing 10 such that when the top opening of the tobacco receiving cavity 11 is closed by the enclosing window 40, the tobacco receiving cavity 11 will house a predetermined amount of the tobacco in order to insert the tobacco into the cigarette tube. It is worth mentioning that the tobacco receiving cavity 11 is normally closed by the enclosing window 40 to prevent the dust and particles entering into the tobacco receiving cavity 11 when the cigarette tobacco filler device is not in use, as shown in FIG. 5.

The cigarette tobacco filler device further comprises a window actuation unit 50 operatively coupled between the enclosing window 40 and the power shaft 31, wherein when the power shaft 31 is rotated, the enclosing window 40 is moved by the window actuation unit 50 to enclose the tobacco receiving cavity 11 before the plunger 21 is moved.

Figure 6:
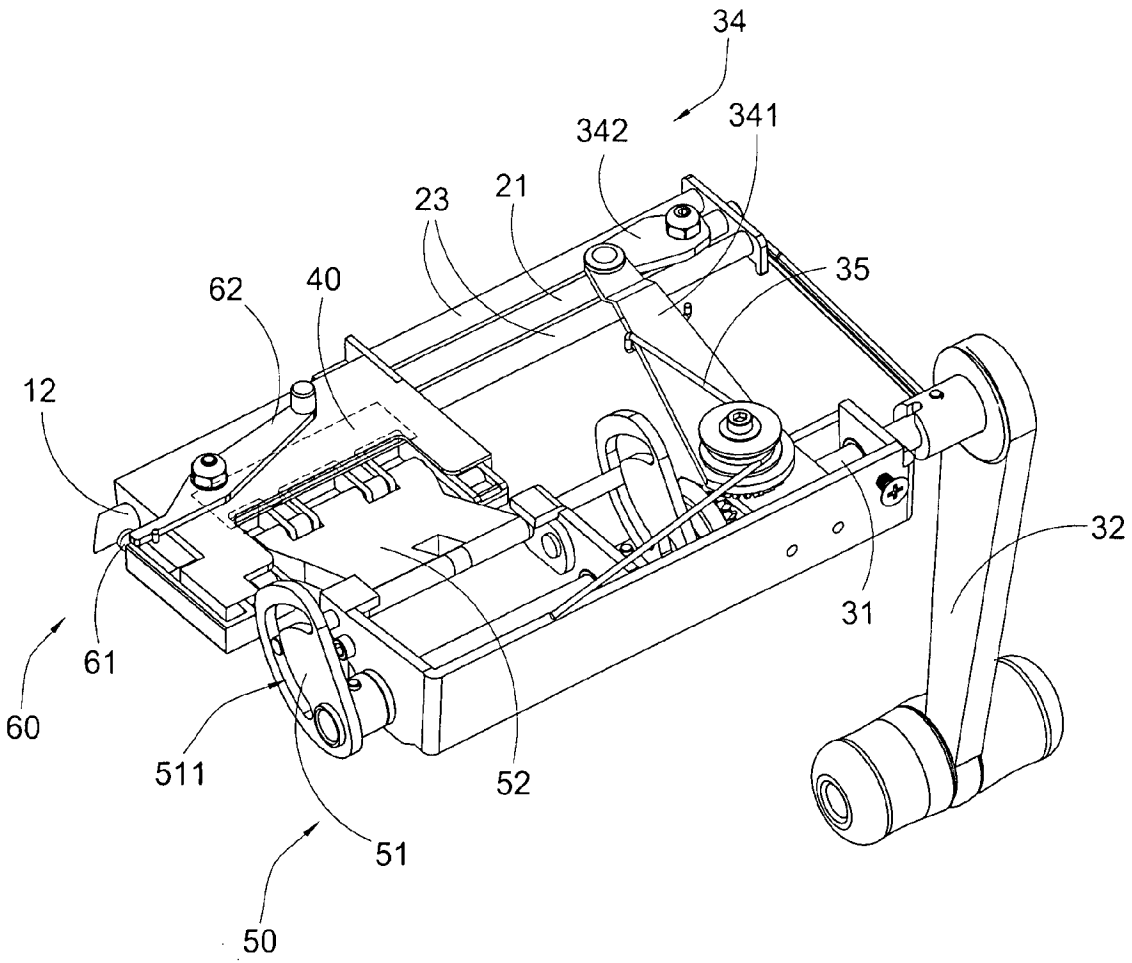
FIG. 6 is a perspective view of the cigarette tobacco filler device according to the above preferred embodiment of the present invention, illustrating the second position of the device to close the tobacco receiving cavity.
Figure 7:
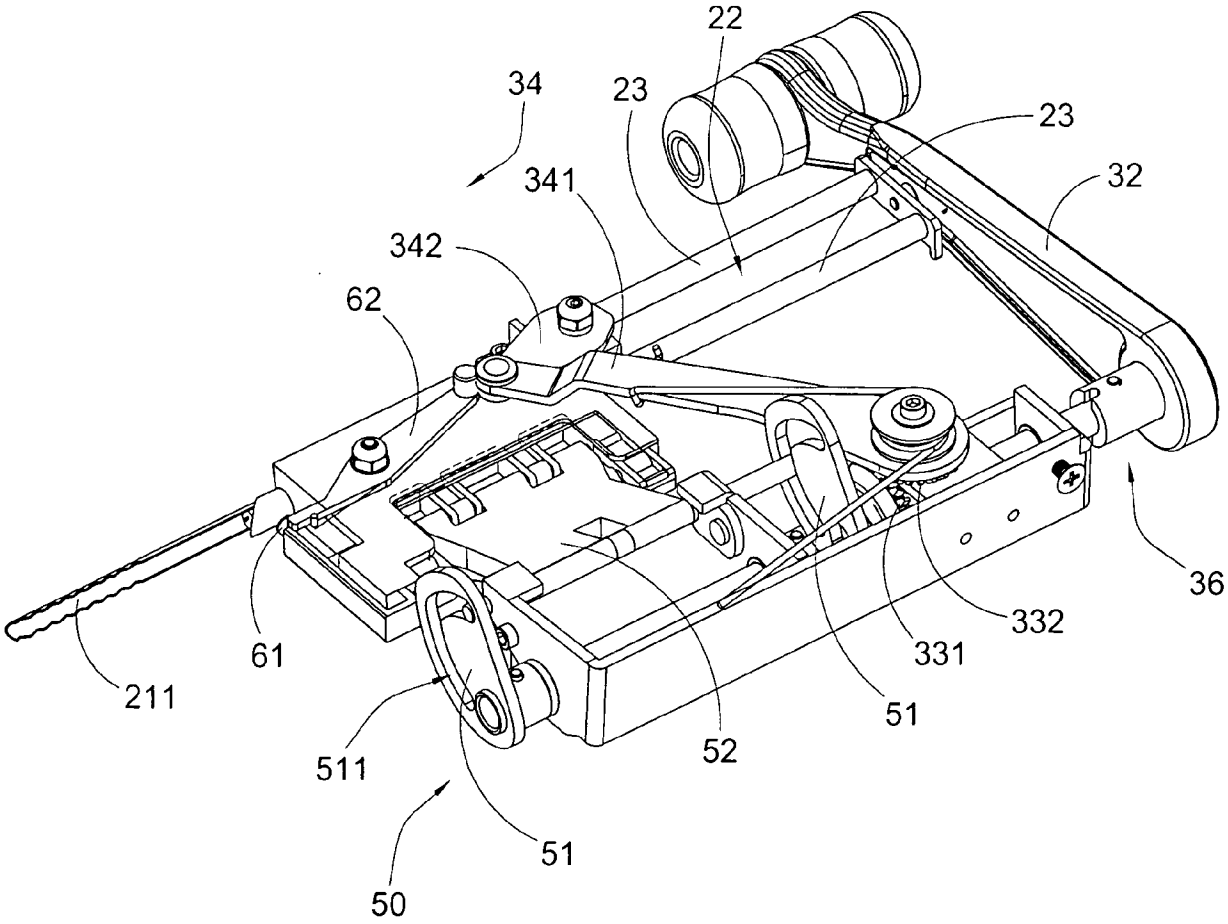
FIG. 7 is a perspective view of the cigarette tobacco filler device according to the above preferred embodiment of the present invention, illustrating the third position of the device to actuate the plunger.

In particular, the window actuation unit 50 is actuated by the power shaft 31 when the non-teething edge portion of the first gear 331 is initially engaged with the second gear 332. Therefore, the enclosing window 40 is actuated to close the tobacco receiving cavity 11 before the actuation of the plunger 21, as shown in FIG. 6. In other words, the operation handle 32 provides dual actions to actuate both the enclosing window 40 and the plunger 21 subsequently in one single pivotally moving down movement. In other words, at the first pivotal moving path of the operation handle 32, i.e. the non-teething edge portion of the first gear 331 is initially engaged with the second gear 332, the enclosing window 40 is actuated to close the tobacco receiving cavity 11. At the second pivotal moving path of the operation handle 32, i.e. the teething edge portion of the first gear 331 is then engaged with the second gear 332, the plunger 21 is actuated to insert the tobacco into the cigarette tube. It is worth mentioning that the first and second pivotal moving paths of the operation handle 32 are continuous movement of the operation handle 32 to pivotally and downwardly move the operation handle 32 toward the top side of the casing 10.

Accordingly, the window actuation unit 50 comprises two swinging members 51 spacedly coupled with the power shaft 31 and a guiding panel 52 being driven to transversely shift by the swinging members 51.

The swinging members 51 are identical and are securely coupled at the power shaft 31, wherein the swinging members 51 are rotatably swung when the power shaft 31 is rotated.

The guiding panel 52 has a first edge movably coupled between the swinging members 51 and an opposed second edge pivotally coupled with the enclosing window 40 in such a manner that when the power shaft 31 is rotated, the swinging members 51 are rotated to transversely shift the guiding panel 52 so as to transversely move the enclosing window 40 for closing the tobacco receiving cavity 11.

Figure 4:
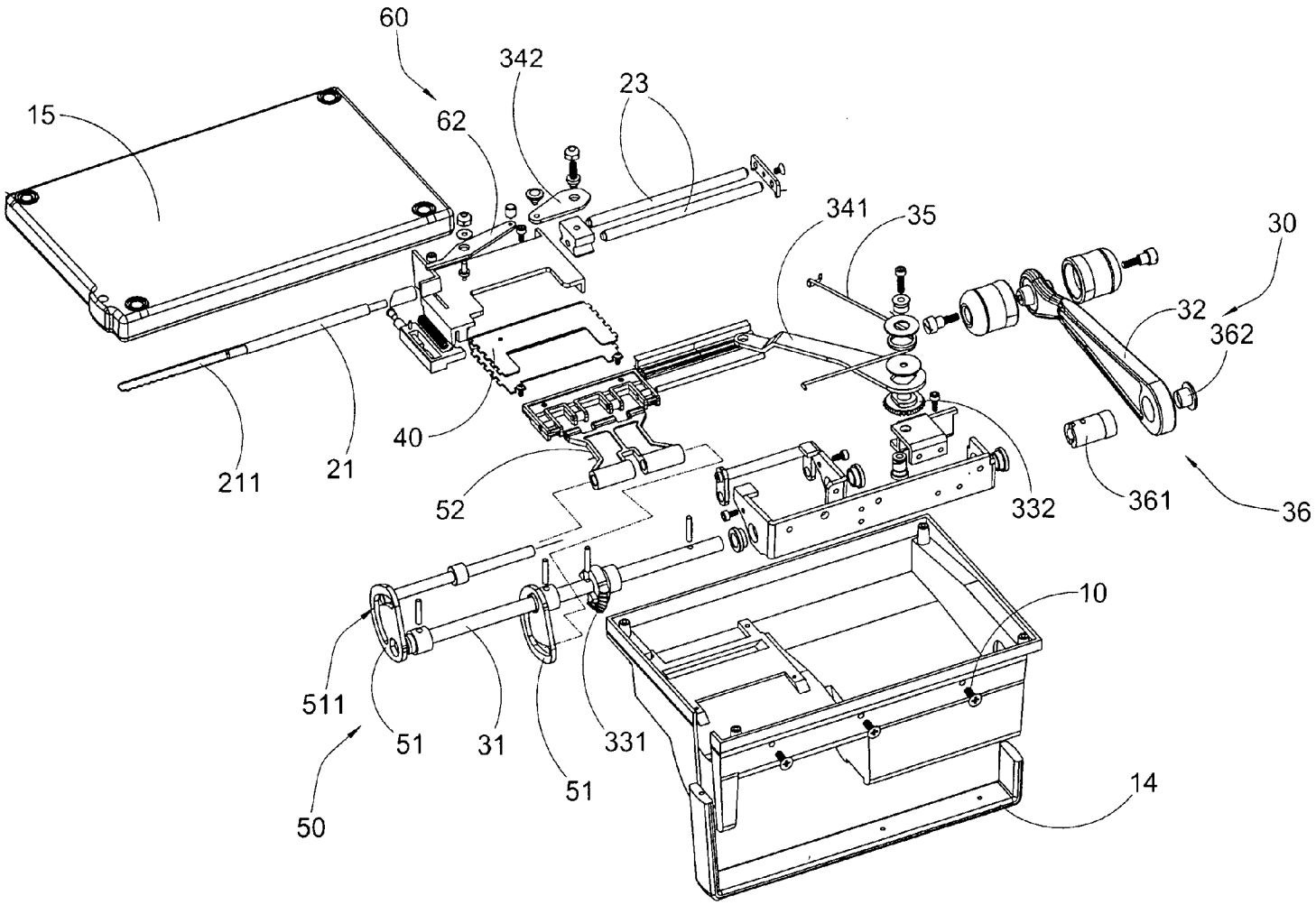
FIG. 4 is an exploded perspective view of the cigarette tobacco filler device according to the above preferred embodiment of the present invention.

In particular, each of the swinging members 51 has an arc-shaped guiding slot 511 that the first edge of the guiding panel 52 is engaged between the guiding slots 511 of the swinging members 51, such that when the swinging members 51 are driven to swing, the first edge of the guiding panel 52 is guided to slide therealong. In other words, when the swinging members 51 are driven to rotate by the power shaft 31, the first edge of the guiding panel 52 is guided to slide along the guiding slots 511 to transversely shift the guiding panel 52. As shown in FIG. 4, the first edge of the guiding panel 52 is engaged with the guiding slots 511 of the swinging members 51 via an elongated swing shaft. In addition, the guiding panel 52 is transversely shifted that when the first edge of the guiding panel 52 is moved downwardly along the guiding slots 511, the second edge of the guiding panel 52 is transversely moved toward the closing direction of the enclosing window 40. When the first edge of the guiding panel 52 is moved upwardly along the guiding slots 511, the second edge of the guiding panel 52 is transversely moved toward the opening direction of the enclosing window 40.

The enclosing window 40 has a pivot edge pivotally coupled with the second edge of the guiding panel 52 via a hinge structure such that when the guiding panel 52 is transversely shifted, the enclosing window 40 is pushed to close the tobacco receiving cavity 11. The enclosing window 40 further has an opposed sharp cutting edge arranged in such a manner that when the enclosing window 40 is transversely moved to close the tobacco receiving cavity 11, the cutting edge is stably moved for cutting excessive amount of the tobacco out of the tobacco receiving cavity 11, so as to retain a predetermined amount of the tobacco in the tobacco receiving cavity 11. It is worth mentioning that the swinging members 51 are concurrently swung about the power shaft 31 to generate an even pushing force toward the guiding panel 52. Therefore, the pushing force from the guiding panel 52 is evenly applied at the pivot edge of the enclosing window 40, such that the enclosing window 40 can be smoothly moved in a well balancing manner.

The cigarette tobacco filler device further comprises a cigarette tube hold-and-release unit 60 for holding the cigarette tube at the outlet 12 and for releasing the cigarette tube from the outlet 12 after the tobacco is filled in the cigarette tube. Accordingly, the cigarette tube hold-and-release unit 60 comprises a tube holding member 61 movably biasing against the outlet 12 for holding the cigarette tube thereat, wherein the tube holding member 61, which is a spring-loaded member, has a holding face for applying a spring holding force at the outer surface of the outlet 12 so as to hold the cigarette tube in position. In particular, the tube holding member 61 is coupled with the enclosing window 40, wherein when the enclosing window 40 is at the opened position, the tube holding member 61 is moved away from the outlet 12 to define a gap between the holding face of the tube holding member 61 and the outer surface of the outlet 12 for the cigarette tube coupling with the outlet 12. When the enclosing window 40 is moved to its closed position, the tube holding member 61 is moved towards until the holding face of the tube holding member 61 is biased against the outer surface of the outlet 12 so as to hold the cigarette tube in position. In other words, the operation handle 32 not only actuates the enclosing window 40 but also actuates the tube holding member 61 at the same time.

The cigarette tube hold-and-release unit 60 further comprises a tube releasing arm 62 which is pivotally supported in the casing 10 and is actuated by the actuation arm 34. The tube releasing arm 62 has a releasing end engaging with the tube holding member 61 and an opposed control end arranged in such a manner that after the actuation arm 34 is moved to actuate the plunger 21 for inserting the tobacco into the cigarette tube, the control end of the tube releasing arm 62 is actuated by the actuation arm 34. Therefore, the releasing end of the tube releasing arm 62 is pivotally moved to move the tube holding member 61 away from the outlet 12 for releasing the cigarette tube from the outlet 12. It is worth mentioning that when the front pushing end 211 of the plunger 21 is moved out of the outlet 12 for inserting the tobacco into the cigarette tube, the tube holding member 61 is moved away from the outlet 12 at the same time. Therefore, the plunger 21 will also push the cigarette tube to detach from the outlet 12 after the tobacco is filled in the cigarette tube.

It is worth mentioning that the operation handle 32 further provides triple actions to actuate all the enclosing window 40, the plunger 21, and the cigarette tube hold-and-release unit 60 subsequently in one single pivotally moving down movement. As it is mentioned above, the first pivotal moving path of the operation handle 32 is to actuate the enclosing window 40 is actuated to close the tobacco receiving cavity 11. The second pivotal moving path of the operation handle 32 is to actuate the plunger 21 is actuated to insert the tobacco into the cigarette tube. The operation handle 32 further provides a third pivotal moving path to actuate the cigarette tube hold-and-release unit 60 to release the cigarette tube from the outlet 12. It is worth mentioning that the first, second, and third pivotal moving paths of the operation handle 32 are continuous movement of the operation handle 32 to pivotally and downwardly move the operation handle 32 toward the top side of the casing 10.

According to the preferred embodiment, the plunger actuation unit 30 further comprises a releasable joint 36 for releasing an engagement between the operation handle 32 and the power shaft 31. Accordingly, all the actuations are powered by the rotation of the power shaft 31. Once the power shaft 31 is in an idle state, all the components cannot be moved correspondingly. The releasable joint 36 is configured as safety device to ensure all the components are at the idle state when the cigarette tobacco filler device is not intentionally used.

The releasable joint 36 comprises a lock sleeve 361 coupled between the operation handle 32 and the power shaft 31 and a releasable lock 362 releasably engaged with the lock sleeve 361 to lock up the operation handle 32 with the power shaft 31. Therefore, when the releasable lock 362 is engaged with the lock sleeve 361, the operation handle 32 can be moved to drive the power shaft 31 to rotate. Likewise, when the releasable lock 362 is disengaged with the lock sleeve 361, the operation handle 32 is freely moved to idle the power shaft 31. It is worth mentioning that when releasable lock 362 is disengaged with the lock sleeve 361, the operation handle 32 will not be totally detached from the power shaft 31. In particular, the operation handle 32 will only be freely rotated without driving the power shaft 31 to rotate. Therefore, when the device is not in use, the tobacco receiving cavity 11 can be enclosed by moving the operation handle 32 to close the tobacco receiving cavity 11 by the enclosing window 40 and by locking the operation handle 32 at the position to retain the enclosing window 40 at the closed position so as to prevent dust or other particles being accumulated in the tobacco receiving cavity 11.

It is worth mentioning that the releasable joint 36 can incorporate with a magnetic alignment unit to align the actuation position of the operation handle 32 with respect to the power shaft 31. In other words, when the releasable lock 362 is re-engaged with the lock sleeve 361, an angular position of the operation handle 32 can be automatically aligned with the power shaft 31 via the magnetic alignment unit before the operation handle 32 is secured to the power shaft 31.

Figure 3A:
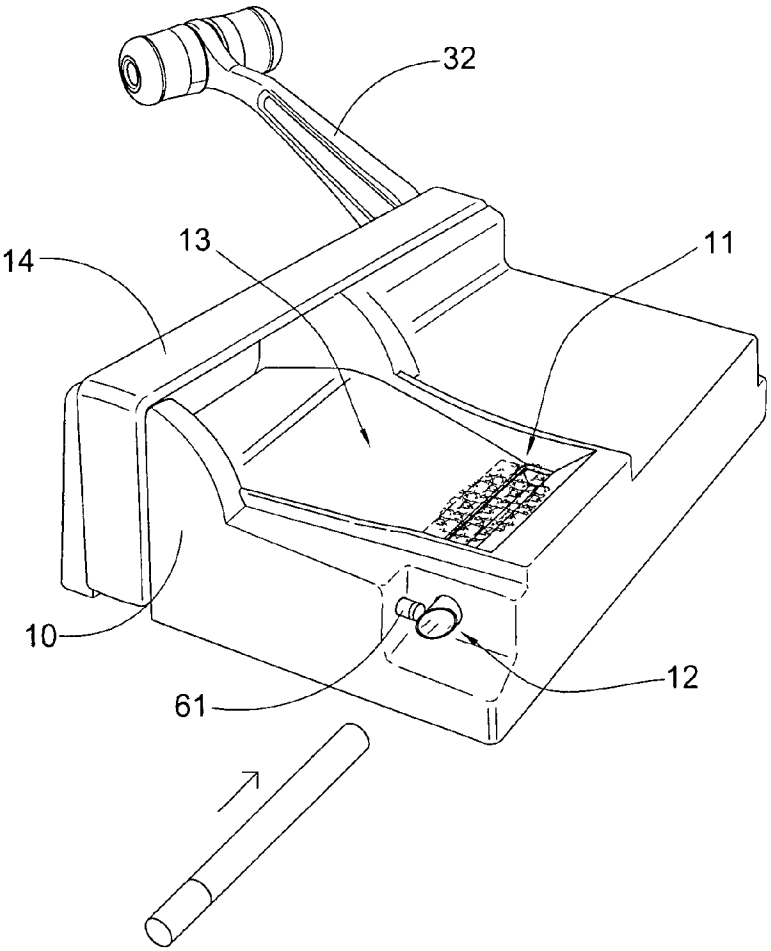
FIG. 3A is a perspective view of a cigarette tobacco filler device according to a preferred embodiment of the present invention, illustrating the operation handle at an initial position for being pivotally and downwardly moved for actuation.
Figure 3B:
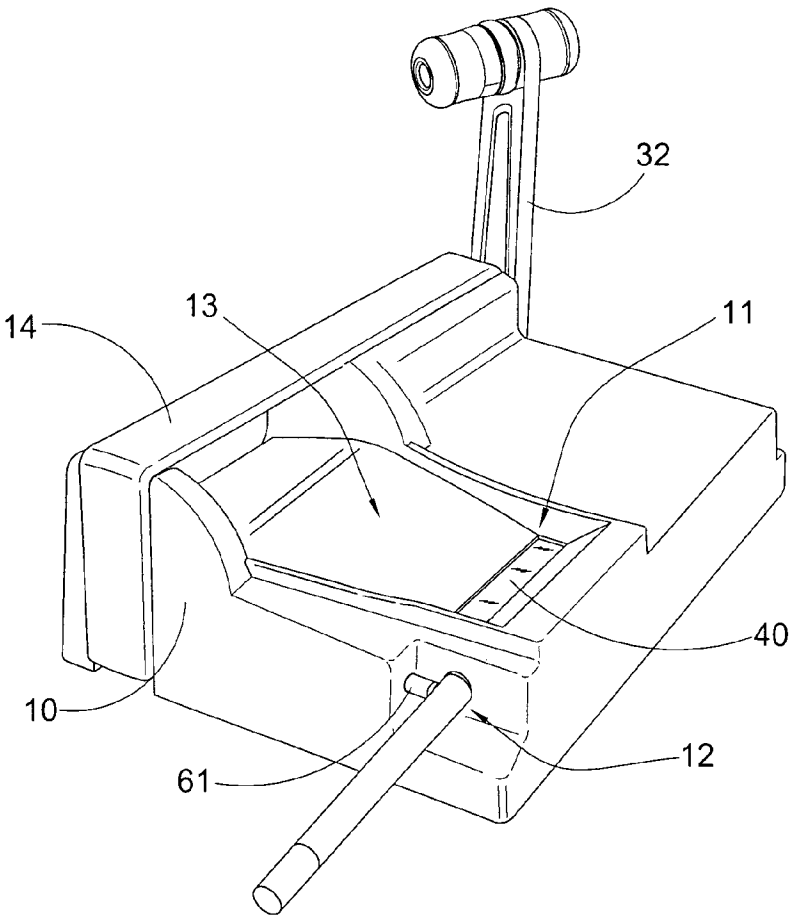
FIG. 3B is a perspective view of the cigarette tobacco filler device according to the above preferred embodiment of the present invention, illustrating the operation handle at a second position for being pivotally and downwardly moved for actuation of the enclosing window.
Figure 3C:
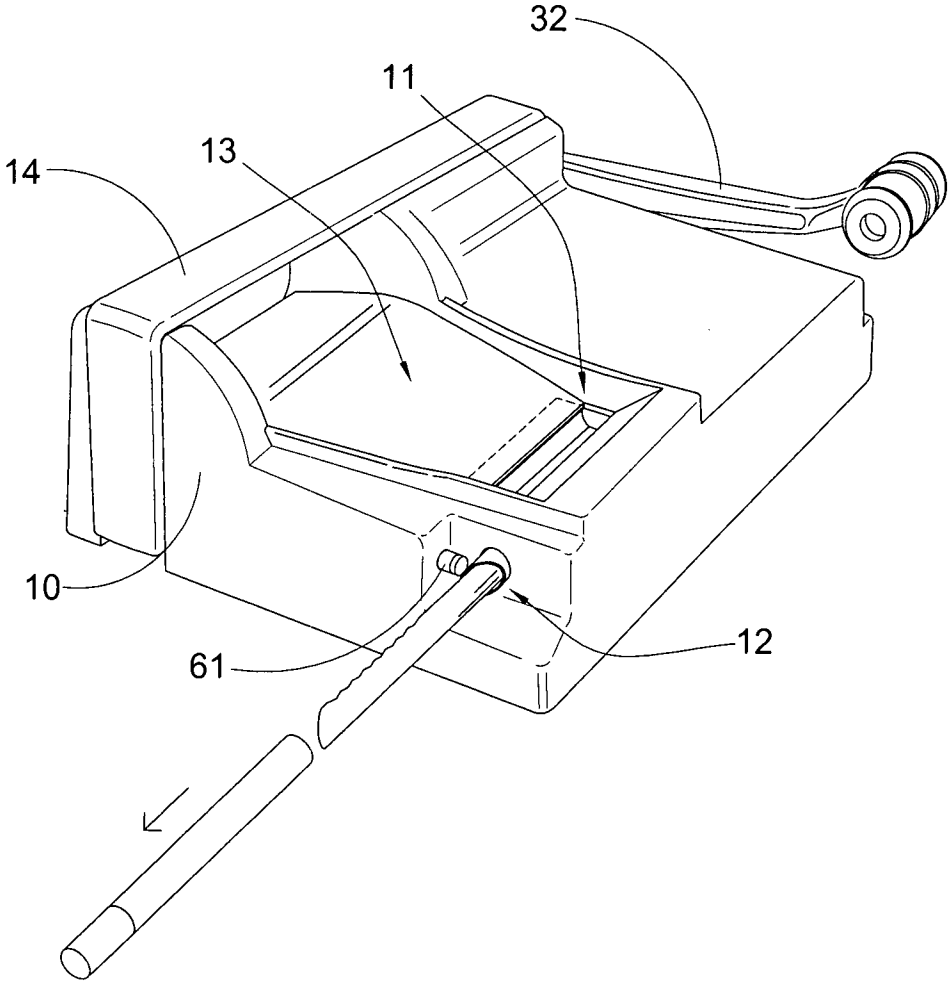
FIG. 3C is a perspective view of the cigarette tobacco filler device according to the above preferred embodiment of the present invention, illustrating the operation handle at a third position for being pivotally and downwardly moved for completing the tobacco insertion actuation.

In order to operate the cigarette tobacco filler device of the present invention, the user is able to pivotally move the operation handle 32 upward from the top side of the casing 10 in order to move the enclosing window 40 for opening up the tobacco receiving cavity 11, as shown in FIG. 3A. At the same time, the tube holding member 61 is moved away from the outlet 12 for the cigarette tube coupling with the outlet 12. Then, the user is able to fill the tobacco into the tobacco receiving cavity 11. When the user ergonomically applies the downward force at the operation handle 32 to pivotally move the operation handle down toward the top side of the casing 10, as shown in FIG. 3B, the enclosing window 40 will be initially actuated to close the tobacco receiving cavity 11 while the tube holding member 61 is moved to the outlet 12 for holding the cigarette tube in position. It is worth mentioning that excessive amount of tobacco will be cut by the cutting edge of the enclosing window 40 to prevent excessive amount of tobacco being inserted into the cigarette tube. Accordingly, the user is able to hold at the handle bar 14 to keep the casing 10 in stable for easily applying the downward force at the operation handle 32. When user keeps applying the downward force at the operation handle 32 to pivotally move the operation handle down to the top side of the casing 10, as shown in FIG. 3C, the plunger 21 is actuated to insert the tobacco into the cigarette tube. It is worth mentioning that during the tobacco inserting operation, the enclosing window 40 is remained at the closed position. Once the operation handle 32 cannot be further moved downwardly, i.e. the tobacco inserting operation is completed, the cigarette tube hold-and-release unit 60 is actuated to release the cigarette tube from the outlet 12. Accordingly, the user only requires a single downward action to pivotally drop down the operation handle 32 in order to hold the cigarette tube in position, to close the tobacco receiving cavity 11, to fill the tobacco into the cigarette tube, and to release the filled cigarette tube from the outlet 12.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A cigarette tobacco filler device for filling a predetermined amount of tobacco into an empty cigarette tube, comprising:

a casing having a tobacco receiving cavity provided at a top side of said casing for receiving the tobacco, and an outlet which is communicated with said tobacco receiving cavity and is adapted for holding the cigarette tube in position;

an injection unit which comprises a plunger movably supported in said casing at a position that a front pushing end of said plunger is moved forward from said tobacco receiving cavity to said outlet for delivering the tobacco into the cigarette tube; and a plunger actuation unit which comprises a power shaft rotatably supported in said casing to couple with said plunger and an operation handle which is pivotally extended above said top side of said casing and is arranged in such a manner that when said operation handle is pivotally moved down to said top side of said casing, said power shaft is driven to rotate so as to actuate said plunger for inserting the tobacco in said tobacco receiving cavity to the cigarette tube at said outlet, wherein said plunger actuation unit further comprises a gear unit driven by said power shaft and an actuation arm having a pivot end operatively coupled with said gear unit and a driving end operatively coupled with said plunger in such a manner that when said power shaft is driven to rotate, said actuation arm is pivotally moved to longitudinally move said plunger forward for pushing said tobacco to said outlet.

2. The cigarette tobacco filler device, as recited in claim 1, wherein said plunger actuation unit further comprises a resilient element coupled at said actuation arm for applying an urging force thereagainst so as to longitudinally move said plunger backward.

3. The cigarette tobacco filler device, as recited in claim 2, wherein said resilient element is a coil spring having a coil portion coaxially coupled at said pivot end of said actuation arm and two spring arms spacedly extended from said coil portion to bias against an inner wall of said casing and said actuation arm respectively.

4. The cigarette tobacco filler device, as recited in claim 1, wherein said gear unit comprises a first gear coaxially coupled at said power shaft and a second gear which is coupled at said pivot end of said actuation arm and is operatively engaged with said first gear, wherein said first gear has a teething edge portion and a non-teething edge portion in such a manner that when said first gear is rotated at a position that said non-teething edge portion of said first gear is engaged with said second gear, said second gear is idle that said actuation arm is remained at a motionless manner, and when said first gear is rotated at a position that said teething edge portion of said first gear is engaged with said second gear, said second gear is driven to rotate to pivotally move said actuation arm so as to longitudinally move said plunger forward.

5. The cigarette tobacco filler device, as recited in claim 3, wherein said gear unit comprises a first gear coaxially coupled at said power shaft and a second gear which is coupled at said pivot end of said actuation arm and is operatively engaged with said first gear, wherein said first gear has a teething edge portion and a non-teething edge portion in such a manner that when said first gear is rotated at a position that said non-teething edge portion of said first gear is engaged with said second gear, said second gear is idle that said actuation arm is remained at a motionless manner, and when said first gear is rotated at a position that said teething edge portion of said first gear is engaged with said second gear, said second gear is driven to rotate to pivotally move said actuation arm so as to longitudinally move said plunger forward.

6. The cigarette tobacco filler device, as recited in claim 5, wherein said injection unit further comprises two plunger guiding arms defining a guiding channel therebetween, wherein said plunger is slidably coupled between said plunger guiding arms along said guiding channel to ensure said plunger being move longitudinally.

7. The cigarette tobacco filler device, as recited in claim 6, wherein said plunger is extended parallelly to said power shaft.

8. The cigarette tobacco filler device, as recited in claim 5, further comprising an enclosing window movably coupled at said casing to enclose said tobacco receiving cavity and a window actuation unit operatively coupled between said enclosing window and said power shaft, wherein when said power shaft is rotated, said enclosing window is moved by said window actuation unit to enclose said tobacco receiving cavity before said plunger is moved.

9. The cigarette tobacco filler device, as recited in claim 7, further comprising an enclosing window movably coupled at said casing to enclose said tobacco receiving cavity and a window actuation unit operatively coupled between said enclosing window and said power shaft, wherein when said power shaft is rotated, said enclosing window is moved by said window actuation unit to enclose said tobacco receiving cavity before said plunger is moved.

10. The cigarette tobacco filler device, as recited in claim 8, wherein said window actuation unit comprises two swinging members spacedly coupled with said power shaft and a guiding panel having a first edge movably coupled between said swinging members and an opposed second edge pivotally coupled with said enclosing window in such a manner that when said power shaft is rotated, said swinging members are rotated to transversely shift said guiding panel so as to transversely move said enclosing window for closing said tobacco receiving cavity.

11. The cigarette tobacco filler device, as recited in claim 9, wherein said window actuation unit comprises two swinging members spacedly coupled with said power shaft and a guiding panel having a first edge movably coupled between said swinging members and an opposed second edge pivotally coupled with said enclosing window in such a manner that when said power shaft is rotated, said swinging members are rotated to transversely shift said guiding panel so as to transversely move said enclosing window for closing said tobacco receiving cavity.

12. The cigarette tobacco filler device, as recited in claim 10, wherein said enclosing window has a pivot edge pivotally coupled with said second edge of said guiding panel and a sharp cutting edge arranged in such a manner that when said enclosing window is transversely moved to close said tobacco receiving cavity, said cutting edge is stably moved for cutting excessive amount of said tobacco out of said tobacco receiving cavity.

13. The cigarette tobacco filler device, as recited in claim 11, wherein said enclosing window has a pivot edge pivotally coupled with said second edge of said guiding panel and a sharp cutting edge arranged in such a manner that when said enclosing window is transversely moved to close said tobacco receiving cavity, said cutting edge is stably moved for cutting excessive amount of said tobacco out of said tobacco receiving cavity.

14. The cigarette tobacco filler device, as recited in claim 11, wherein each of said swinging members has an arc-shaped guiding slot that said first edge of said guiding panel is engaged between said guiding slots of said swinging members such that when said swinging members are driven to rotate by said power shaft, said first edge of said guiding panel is guided to slide along said guiding slots to transversely shift said guiding panel.

15. The cigarette tobacco filler device, as recited in claim 13, wherein each of said swinging members has an arc-shaped guiding slot that said first edge of said guiding panel is engaged between said guiding slots of said swinging members such that when said swinging members are driven to rotate by said power shaft, said first edge of said guiding panel is guided to slide along said guiding slots to transversely shift said guiding panel.

16. The cigarette tobacco filler device, as recited in claim 8, wherein said enclosing window is actuated to close said tobacco receiving cavity when said second gear is engaged with said non-teething edge portion of said first gear.

17. The cigarette tobacco filler device, as recited in claim 11, wherein said enclosing window is actuated to close said tobacco receiving cavity when said second gear is engaged with said non-teething edge portion of said first gear.

18. The cigarette tobacco filler device, as recited in claim 15, wherein said enclosing window is actuated to close said tobacco receiving cavity when said second gear is engaged with said non-teething edge portion of said first gear.

19. The cigarette tobacco filler device, as recited in claim 1, further comprising a cigarette tube hold-and-release unit for holding the cigarette tube at said outlet and for releasing the cigarette tube from said outlet after said tobacco is filled in the cigarette tube, wherein said cigarette tube hold-and-release unit comprises a tube holding member movably biasing against said outlet for holding the cigarette tube thereat and a tube releasing arm which is pivotally supported in said casing and is actuated by said actuation arm in such a manner that after said actuation arm is moved to actuate said plunger for inserting the tobacco into the cigarette tube, said tube releasing arm is actuated by said actuation arm to move said tube holding member away from said outlet for releasing the cigarette tube from said outlet.

20. The cigarette tobacco filler device, as recited in claim 18, further comprising a cigarette tube hold-and-release unit for holding the cigarette tube at said outlet and for releasing the cigarette tube from said outlet after said tobacco is filled in the cigarette tube, wherein said cigarette tube hold-and-release unit comprises a tube holding member movably biasing against said outlet for holding the cigarette tube thereat and a tube releasing arm which is pivotally supported in said casing and is actuated by said actuation arm in such a manner that after said actuation arm is moved to actuate said plunger for inserting the tobacco into the cigarette tube, said tube releasing arm is actuated by said actuation arm to move said tube holding member away from said outlet for releasing the cigarette tube from said outlet.

21. The cigarette tobacco filler device, as recited in claim 20, wherein said plunger actuation unit further comprises a releasable joint for releasing an engagement between said operation handle and said power shaft, wherein said releasable joint comprises a lock sleeve coupled between said operation handle and said power shaft and a releasable lock releasably engaged with said lock sleeve to lock up said operation handle with said power shaft, such that when said releasable lock is disengaged with said lock sleeve, said operation handle is freely moved to idle said power shaft.

22. A cigarette tobacco filler device for filling a predetermined amount of tobacco into an empty cigarette tube, comprising:

a casing having a tobacco receiving cavity provided at a top side of said casing for receiving the tobacco, and an outlet which is communicated with said tobacco receiving cavity and is adapted for holding the cigarette tube in position;

an injection unit which comprises a plunger movably supported in said casing at a position that a front pushing end of said plunger is moved forward from said tobacco receiving cavity to said outlet for delivering the tobacco into the cigarette tube; and a plunger actuation unit which comprises a power shaft rotatably supported in said casing to couple with said plunger and an operation handle which is pivotally extended above said top side of said casing and is arranged in such a manner that when said operation handle is pivotally moved down to said top side of said casing, said power shaft is driven to rotate so as to actuate said plunger for inserting the tobacco in said tobacco receiving cavity to the cigarette tube at said outlet, wherein said plunger is extended parallelly to said power shaft.

23. A cigarette tobacco filler device for filling a predetermined amount of tobacco into an empty cigarette tube, comprising:

a casing having a tobacco receiving cavity provided at a top side of said casing for receiving the tobacco, and an outlet which is communicated with said tobacco receiving cavity and is adapted for holding the cigarette tube in position;

an injection unit which comprises a plunger movably supported in said casing at a position that a front pushing end of said plunger is moved forward from said tobacco receiving cavity to said outlet for delivering the tobacco into the cigarette tube;

a plunger actuation unit which comprises a power shaft rotatably supported in said casing to couple with said plunger and an operation handle which is pivotally extended above said top side of said casing and is arranged in such a manner that when said operation handle is pivotally moved down to said top side of said casing, said power shaft is driven to rotate so as to actuate said plunger for inserting the tobacco in said tobacco receiving cavity to the cigarette tube at said outlet; and an enclosing window movably coupled at said casing to enclose said tobacco receiving cavity and a window actuation unit operatively coupled between said enclosing window and said power shaft, wherein when said power shaft is rotated, said enclosing window is moved by said window actuation unit to enclose said tobacco receiving cavity before said plunger is moved.

24. The cigarette tobacco filler device, as recited in claim 23, wherein said window actuation unit comprises two swinging members spacedly coupled with said power shaft and a guiding panel having a first edge movably coupled between said swinging members and an opposed second edge pivotally coupled with said enclosing window in such a manner that when said power shaft is rotated, said swinging members are rotated to transversely shift said guiding panel so as to transversely move said enclosing window for closing said tobacco receiving cavity.

25. The cigarette tobacco filler device, as recited in claim 24, wherein said enclosing window has a pivot edge pivotally coupled with said second edge of said guiding panel and a sharp cutting edge arranged in such a manner that when said enclosing window is transversely moved to close said tobacco receiving cavity, said cutting edge is stably moved for cutting excessive amount of said tobacco out of said tobacco receiving cavity.

26. A cigarette tobacco filler device for filling a predetermined amount of tobacco into an empty cigarette tube, comprising:

a casing having a tobacco receiving cavity provided at a top side of said casing for receiving the tobacco, and an outlet which is communicated with said tobacco receiving cavity and is adapted for holding the cigarette tube in position;

an injection unit which comprises a plunger movably supported in said casing at a position that a front pushing end of said plunger is moved forward from said tobacco receiving cavity to said outlet for delivering the tobacco into the cigarette tube; and a plunger actuation unit which comprises a power shaft rotatably supported in said casing to couple with said plunger and an operation handle which is pivotally extended above said top side of said casing and is arranged in such a manner that when said operation handle is pivotally moved down to said top side of said casing, said power shaft is driven to rotate so as to actuate said plunger for inserting the tobacco in said tobacco receiving cavity to the cigarette tube at said outlet, wherein said plunger actuation unit further comprises a releasable joint for releasing an engagement between said operation handle and said power shaft, wherein said releasable joint comprises a lock sleeve coupled between said operation handle and said power shaft and a releasable lock releasably engaged with said lock sleeve to lock up said operation handle with said power shaft, such that when said releasable lock is disengaged with said lock sleeve, said operation handle is freely moved to idle said power shaft.

* * * * *